United States Patent [19]

O'Connor

[11] 4,015,788

[45] Apr. 5, 1977

[54] PAPER ROLL AND SPINDLE EJECTION DEVICE

[76] Inventor: Robert O'Connor, 1777 E. 48th St., Brooklyn, N.Y. 11204

[22] Filed: Dec. 22, 1975

[21] Appl. No.: 642,974

[52] U.S. Cl. ..... 242/55.2; 242/55.53

[51] Int. Cl.[2] ..... A47K 10/18

[58] Field of Search ..... 242/55.2, 55.53, 55.3

[56] References Cited

UNITED STATES PATENTS

| | | | |
|---|---|---|---|
| 2,313,776 | 3/1943 | Segal | 242/55.53 |
| 2,602,601 | 7/1952 | Balz | 242/55.53 |
| 3,037,718 | 6/1962 | Pettit | 242/55.53 |

*Primary Examiner*—George F. Mautz
*Attorney, Agent, or Firm*—Kenyon & Kenyon Reilly Carr & Chapin

[57] ABSTRACT

A paper roll-spindle ejection device can be operated manually by one hand and includes a mounting plate for securing the device relative to a paper dispenser or paper roll wall mounting. An actuator tab is hinged to the mounting plate and carries two fingers. These fingers are hinged on the tab and extend into the space between the spindle and the otherwise contiguous surface of the dispenser. By pressing the tab, the fingers compress the spindle and urge the spindle and empty core of the paper roll out of the dispenser.

13 Claims, 5 Drawing Figures

PAPER ROLL AND SPINDLE EJECTION DEVICE

This invention relates to an ejection device for empty paper rolls, and more particular, to an ejection device which facilitates ejection of an empty toilet paper roll from a wall mounting.

As is known, various devices have been used to facilitate the removal of an empty toilet paper roll from a wall mounting or from a dispenser. However, in many cases, the devices have been rather complicated and/or expensive due to reliance on eject mechanisms requiring articulated linkages. Also, in many cases, these devices have not been readily usable with a typical wall mounting in which a paper roll is mounted in a recessed condition.

As is known, compressible spindles are frequently used with a recessed mounting in order to mount a paper roll in place. While various devices have also been known for compressing such spindles in order to permit removal, the devices have usually been cumbersome. For example, one known proposal is to use a wire clip on one end of a compressible spindle which projects from a recessed mounting when the spindle and an empty roll is to be removed. When the roll is empty, the clip is to be pressed as a lever against the wall to compress the spindle and, thereafter, move the spindle from the wall recess. However, during emptying of the roll, such a clip may well project from the spindle and may cause injury. Further, continued use of such a clip may well deform the clip about the wall. As a result, the entire assembly of spindle and clip would eventually require replacement.

In many of the above cases, the devices proposed for removing an empty toilet paper roll from a wall mounting would be particularly difficult for youngsters and senior citizens to use, and especially people suffering from infirmities such as arthritis.

Accordingly, it is an object of the invention to provide an ejection device for paper rolls which is of simple construction.

It is another object of the invention to provide an ejection device for empty paper rolls which can be easily mounted in place.

It is another object of the invention to provide an ejection device of relatively inexpensive construction.

It is another object of the invention to provide a paper roll ejection device which can be mounted adjacent a recessed wall mounting without the need of altering the mounting or roll spindle.

It is another object of the invention to provide an ejection device which may be manipulated with one hand.

Briefly, the invention provides an ejection device for ejecting a paper roll and spindle from a mounting such as a wall mounting. The device is particularly useable with a longitudinally compressible spindle which is rotatably mounted in the wall mounting. To this end, the ejection device includes a mounting plate for securing the device to the mounting, a tab which is pivotally mounted on the mounting plate and a pair of spaced apart fingers mounted on the tab which extend substantially perpendicularly to the mounting plate.

The mounting is generally of a recessed type which includes a pair of oppositely disposed recesses to receive trunnions of the spindle. The ejection device is mounted astride the spindle with the mounting plate secured to the mounting by means of an adhesive or other securing means. The tab projects from the mounting plate at a slight inclined angle outwardly of the mounting while the fingers extend between the spindle and the mounting astride one of the spindle trunnions.

When a paper roll has been emptied, the tab of the ejection device is pressed towards the mounting plate so that the two fingers pivot toward the spindle to compress the spindle. Continued pressing on the tab and continued pivoting of the fingers permits the fingers to move into the emptied core of the paper roll while further compressing the spindle. Thereafter, once the trunnion of the spindle has moved out of the recess of the mounting, the spindle slides along the fingers out of the mounting along with the core. During this latter time, a snap-action effect occurs to cause the spindle and emptied core to be popped out of the mounting to such an extent that the spindle and core can be easily grasped and removed.

In order to introduce a fresh paper roll, the fingers of the ejection device are rotated against the wall of the mounting and the spindle introduced in a conventional manner.

These and other objects and advantages of the invention will become more apparent from the following detailed description and appended claims taken in conjunction with the accompanying drawings in which:

Figure 1:
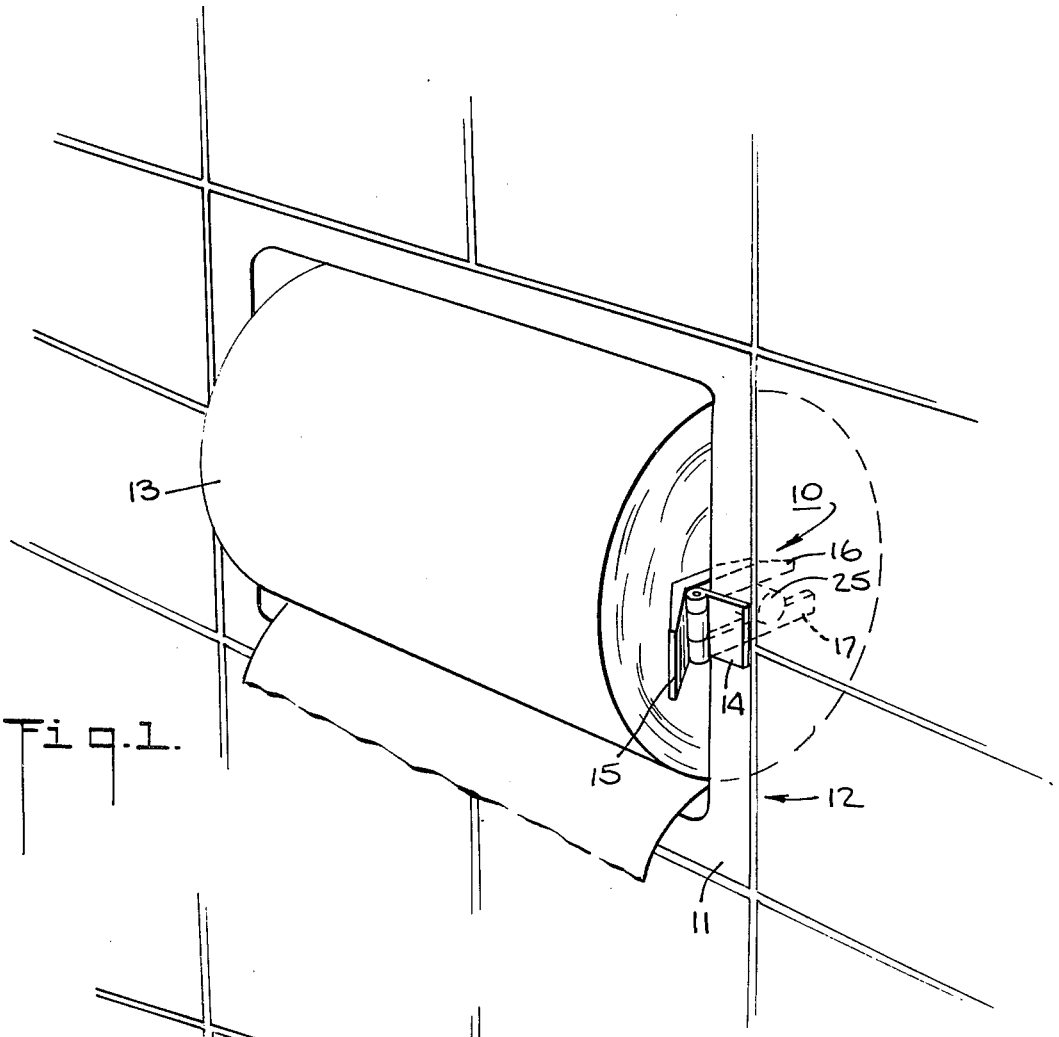
FIG. 1 illustrates a perspective view of an ejection device of the invention mounted in place with a full roll of paper in a recessed wall mounting.

Referring to FIG. 1, the injection device 10 is mounted to an outside surface 11 of a toilet paper mounting 12 of a type which forms a recess within a wall and which allows a full roll of paper 13 to project from the recess.

Figure 3:
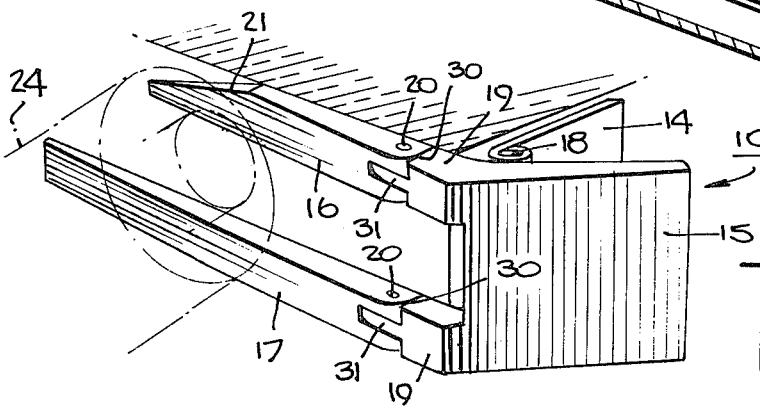
FIG. 3 illustrates an enlarged view of the ejection device of FIG. 1.

Referring to FIGS. 1 and 3, the ejection device 10 includes a means, such as a mounting plate 14 for fixedly securing the device 10 to the mounting surface 11 for example by means of an adhesive such as an epoxy cement, or other suitable mounting means. In addition, the device 10 includes a tab 15 hinged to the plate 14 and a pair of fingers 16, 17.

Referring to FIG. 3, the tab 15 is hinged to the mounting plate by means of a hinge pin 18 which passes through suitable interengaging ring portions on the mounting plate 14 and tab 15. In addition, the tab has a bifurcated section forming a pair of ears 19. The fingers 16, 17 are hinged to the respective ears 19 by suitable hinge pins 20. The upper finger 16 is of shorter length than the lower finger 17 and has a cross-section which tapers in the manner of a wedge toward the free end. In addition, the upper surface 21 near the end portion of the finger 16 tapers downwardly at an incline so as to form a cam surface for purposes as explained below. The lower finger 17 is likewise tapered in cross-section in the manner of a wedge towards the free end.

Figure 4:
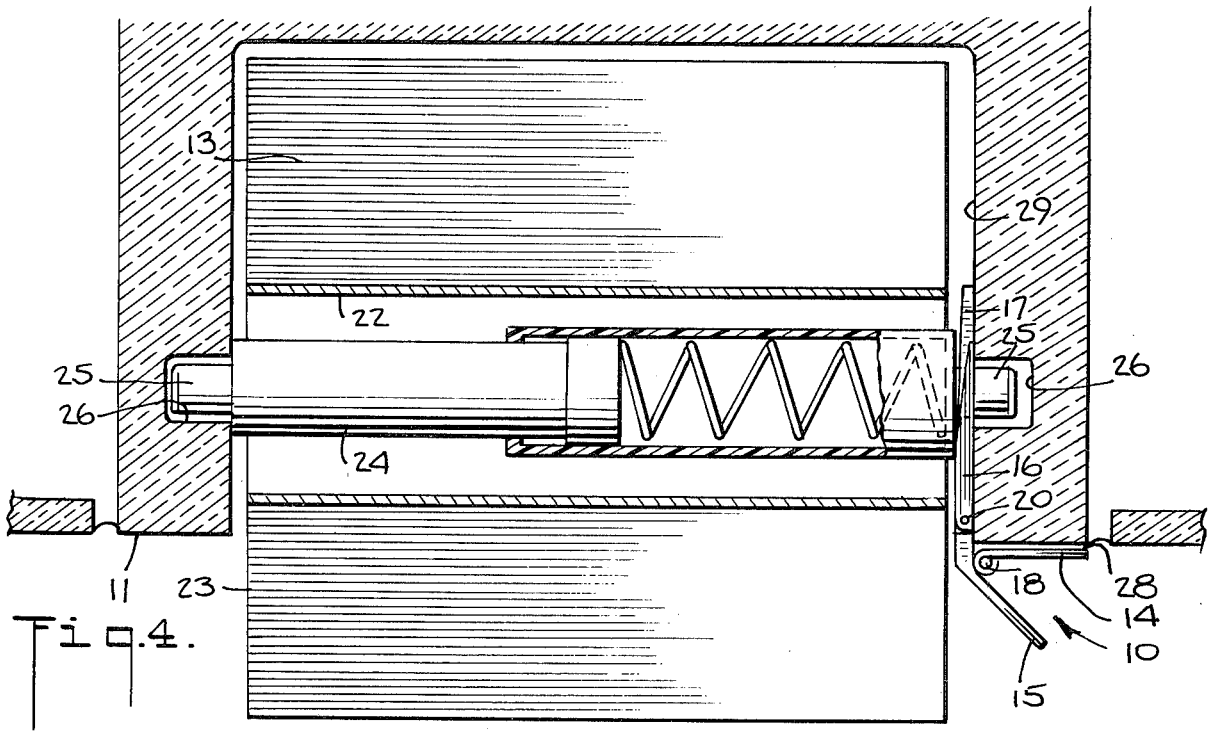
FIG. 4 illustrates a part cross-sectional view of compressible roll of FIG. 1 in relation to the ejection device.

Referring to FIG. 4, the roll of paper 13 includes a core 22 on which a web of paper 23 is rolled in conventional fashion. The paper roll 13 is mounted on a longitudinally compressible spindle 24 having a pair of trunnions 25 each of which is located within a recess 26 of the wall mounting 12. In addition, a spring 27 is located within the spindle 24 in order to bias the two telescoping portions of the spindle 24 away from each other. As shown, the two fingers 16, 17 of the ejection device 10 straddle the trunnion 25 at one end of the spindle 24.

As shown in FIG. 4, when in place, the ejection device 10 has the mounting plate 14 secured to the surface 11 of the mounting 12, for example, by means of a suitable adhesive 28. In addition, the fingers 16, 17 are flat against the inside wall surface 29 of the mounting 12. The fingers 16, 17 are sized to project beyond the recess 26 astride the trunnion 25 of the spindle 24. In this position, the wedge-like surfaces of the fingers 16, 17 engage against the spindle 24 or may be slightly spaced from the spindle. In addition, the two fingers 16, 17 are sized to terminate within the plane of the core 22.

Figure 2:
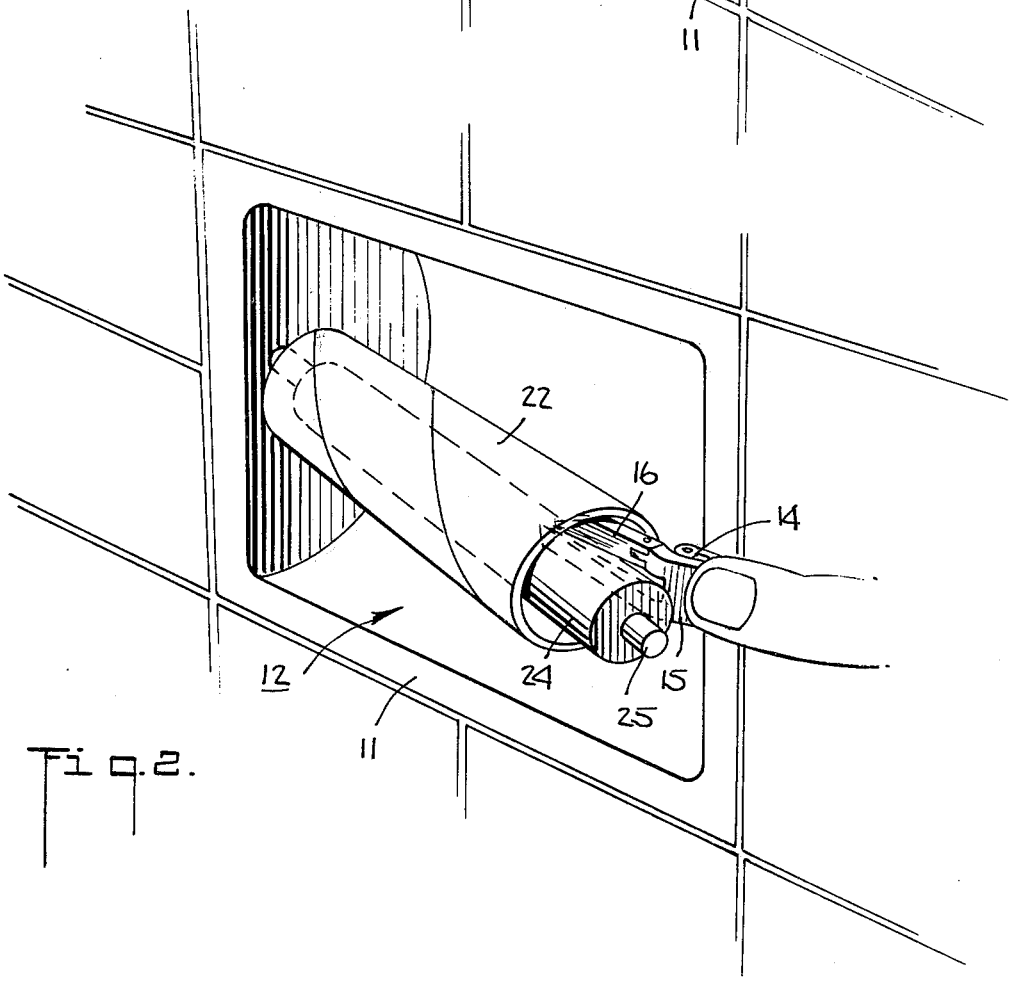
FIG. 2 illustrates a perspective view of the ejection device with showing an empty paper roll core and spindle in an ejected condition.

When in use, in order to remove the core 22 of an empty paper roll and the spindle 24, the tab 15 is pressed manually as shown in FIG. 2 towards the wall mounting 12. This causes the fingers 16, 17 to pivot towards the spindle 24 and, at the same time, to move into the interior of the core 22. Movement of the upper finger 16 into the core 22 is facilitated by the cam surface 21 and the narrowed terminal end of the finger 16. As this terminal end initially moves into the core 22, the core begins to slide on the cam surface 21 while being raised slightly. At the same time, the lower finger 17 moves into the interior of the core 22. During this time, the fingers 16, 17 compress the spindle 24. Continued movement of the fingers 16, 17 causes the trunnion 25 to move out of the recess 26 and, thereafter, causes the spindle 24 to slide along the surfaces of the fingers 16, 17 in a direction out of the mounting 12 (see FIGS. 2 and 5). After the trunnion 25 has cleared the recess 26 and the spindle 24 has moved to some degree along the fingers 16, 17, a snap action effect occurs. At this time, the spindle 24 and roll core 22 pop out of the wall mounting 12.

During the time that the spindle is popped out of the wall mounting 12, the fingers 16, 17 pivot outwardly of the mounting to facilitate ejection of the core 22 and spindle 24.

Figure 5:
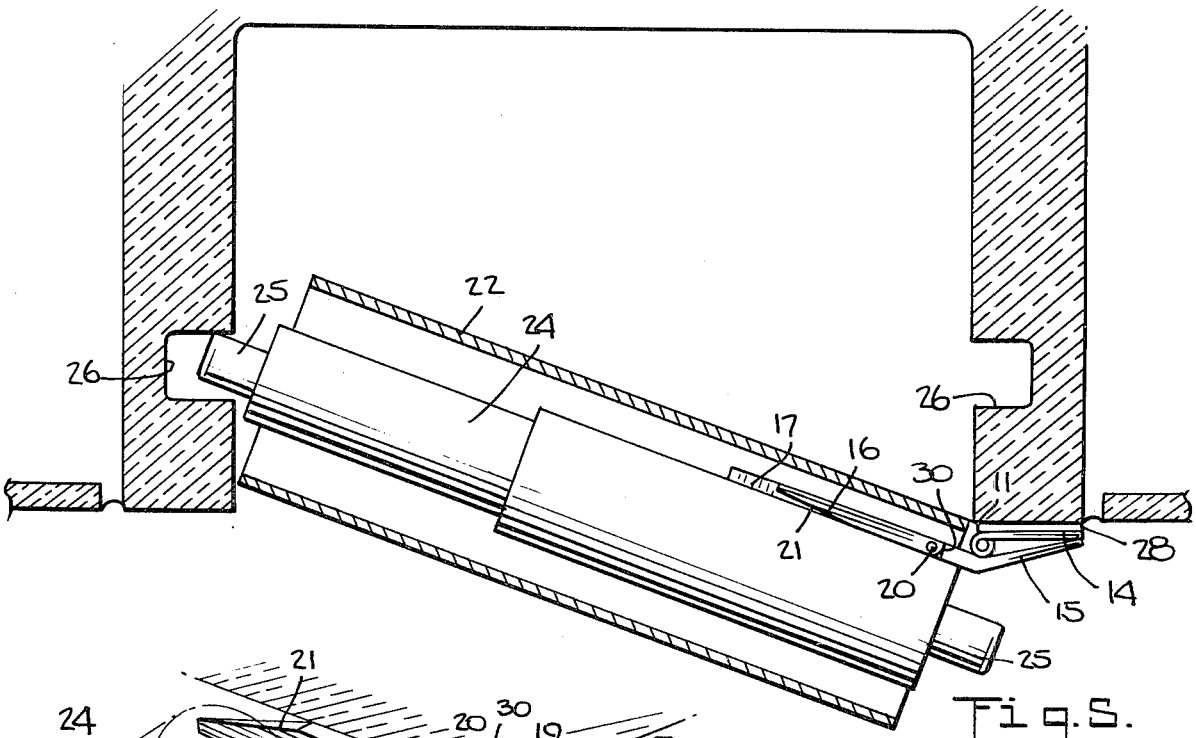
FIG. 5 illustrates a plan view of the ejection device with an ejected paper roll core shown in section.

In the event that the core 22 and spindle 24 do not pop away from the mounting 12, a condition may arise as shown in FIG. 5. In this condition, the spindle 24 may be slid out of the core 22 and then the core 22 manipulated out of the mounting 12 off the fingers 16, 17.

Referring to FIG. 3, the ejection device 10 also includes a means for limiting pivoting of the finger 16, 17 on the tab ears 19 in a direction away from the spindle 24, for example, the means may be in the form of cam surfaces 30 on the rear of each finger 16, 17 which engage against the ears 19 to stop pivoting. Alternatively, or in addition, similar stop surfaces may be formed on the extension 30 of each ear 19 within the bifurcated portions of the finger 16, 17 to act as abutments to limit rotation of the finger 16, 17 on the tab 15 in the direction of the wall 29 of the mounting 12. In this way, the finger 16, 17 may be limited to rotate through a total angle of about 90° relative to the tab 15.

The inclination of the vertical surface, as viewed in FIG. 3, of the finger 16, 17 engaging the spindle 24 serve to minimize the contact surface between the fingers 16, 17 and spindle 24. This reduces the friction which might otherwise unduly restrain rotation of the paper roll 13.

When a roll of paper 13 is to be placed in the mounting 12, the spindle 24 is inserted inside the paper core 22. Thereafter, with the finger 16, 17 of the ejection device 10 flat against the wall 29 of the mounting 12 (as in FIG. 1), the spindle 24 is compressed and the trunnions 25 guided into the respective recesses 26 in the usual manner. During this time, the spindle 24 may slide along the fingers 16, 17 until the trunnion 25 pops into place in the respective recess 26.

The invention thus provides an ejection device which provides for easy removal of an empty paper roll from a recessed wall mounting. To this end, removal may be effected simply by the use of finger pressure exerted at an exterior surface of the mounting rather than from within. Further, the invention provides an ejection device which can be readily mounted on existing equipment, particularly of the recessed type. In addition, the ejection device may be mounted on a stand-off type of paper holder. The manner of securing the ejection device to a wall mounting may be effected in various manners. For example, adhesives may be used to secure the mounting plate in place or screws or bolts may be used to mechanically secure the mounting plate in place.

The invention further provides an ejection device which may be manufactured and assembled in a relatively inexpensive manner. To this end, the ejection device may be made of metals or plastics.

In addition, should the ejection device become damaged, the device may be readily removed and replaced by a new ejection device in a relatively simple manner without any need to modify the spindle for the paper rolls.

What is claimed is:

1. An ejection device for ejecting a paper roll and spindle from a mounting having first means for fixedly securing said device relative to the location of a paper roll and spindle positioned in the mounting;

actuator plate means pivotally affixed to said mounting; and a pair of fingers pivotally attached to said actuator plate means for pivoting therewith, said fingers being disposed in spaced relation to each other to straddle a trunnion of the spindle and to be interposed between the side of the spindle and a surface of the mounting.

2. An ejection device as set forth in claim 1 wherein said actuator plate means comprises a tab portion hinged to said first means and a bifurcated extension extending from said tab portion, said extension having said pair of fingers pivotally attached thereon.

3. An ejection device as set forth in claim 1 wherein each of said fingers is of decreasing thickness in a direction away from said extension to define a cam surface facing the spindle.

4. An ejection device as set forth in claim 1 wherein the uppermost of said fingers has a chamfered upper edge for sliding of a core of the paper roll thereon during penetration of said uppermost finger into the core of the paper roll during ejection.

5. An ejection device as set forth in claim 1 which further has means to limit pivoting of said fingers on said extension in a direction away from the spindle.

6. An ejection device as set forth in claim 1 wherein at least one of said fingers has a length whereby the end thereof, most inwardly disposed, is located within the projected plane of a core of the paper roll.

7. An ejection device as set forth in claim 6 wherein said one finger has a chamfered edge whereby contact with the core of the paper roll is avoided during ejection.

8. An ejection device as set forth in claim 7 wherein the other of said fingers has a length whereby the end thereof, most inwardly disposed, is located beyond the edge of the spindle in proximity thereto, whereby the spindle and the core are urged outward from the dispenser during ejection.

9. An ejection device for a paper roll mounted on a rotatable spindle within a mounting, said device including a mounting plate, a tab pivotally mounted on said mounting plate, and a pair of spaced apart fingers hingedly mounted on one end of said tab and extending substantially perpendicularly of said mounting plate.

10. An ejection device as set forth in claim 9 which further includes an adhesive layer on one side of said mounting plate for securing said plate to the mounting.

11. In combination, a wall mounting;

a longitudinally compressible spindle rotatably mounted in said mounting;

a paper roll having a core mounted on said spindle;

an ejection device for ejecting said spindle and core from said mounting after emptying of said paper roll, said device including a mounting plate, a tab pivotally mounted on said plate, and a pair of fingers mounted on said tab and extending between said spindle and said mounting to compress said spindle upon pivoting of said tab towards said mounting plate; and means securing said mounting plate to said mounting.

12. The combination as set forth in claim 11 wherein said wall mounting includes a pair of oppositely disposed recesses and said spindle has a pair of oppositely disposed trunnions each received within a respective recess; and wherein said pair of fingers straddle one of said trunnions.

13. The combination as set forth in claim 12 wherein said fingers are hingedly mounted on said tab and said ejection device further includes means for limiting pivoting of said fingers on said tab in a direction away from said spindle.

* * * * *

UNITED STATES PATENT AND TRADEMARK OFFICE

CERTIFICATE OF CORRECTION

PATENT NO. : 4,015,788

DATED : April 5, 1977

INVENTOR(S) : Robert O'Connor

It is certified that error appears in the above-identified patent and that said Letters Patent are hereby corrected as shown below:

In the title page, correct the Application No. from "642,974" to --642,794--.

Signed and Sealed this

Fourteenth Day of June 1977

[SEAL]

*Attest:*

RUTH C. MASON
*Attesting Officer*

C. MARSHALL DANN
*Commissioner of Patents and Trademarks*